US008459057B2

(12) United States Patent
Kim et al.

(10) Patent No.: US 8,459,057 B2
(45) Date of Patent: Jun. 11, 2013

(54) REFRIGERATOR WITH ICE SUPPLY DEVICE

(75) Inventors: Ji Hoon Kim, Gwangji (KR); Jin Ho Kim, Gwangji (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 911 days.

(21) Appl. No.: 12/588,260

(22) Filed: Oct. 8, 2009

(65) Prior Publication Data

US 2010/0126203 A1 May 27, 2010

(30) Foreign Application Priority Data

Nov. 27, 2008 (KR) ..... 10-2008-118904

(51) Int. Cl.
*F25C 5/18* (2006.01)

(52) U.S. Cl.
USPC ..... 62/344; 62/337; 62/377; 62/345; 222/146.6

(58) Field of Classification Search
USPC ..... 62/344, 337, 377, 345; 220/827, 220/829, 830, 601; 222/146.6, 511, 517
See application file for complete search history.

(56) References Cited

U.S. PATENT DOCUMENTS

| | | | | | |
|---|---|---|---|---|---|
| 5,685,624 | A * | 11/1997 | Lee | 312/405.1 |
| 6,053,544 | A * | 4/2000 | Alvring et al. | 292/203 |
| 6,082,130 | A * | 7/2000 | Pastryk et al. | 62/344 |
| 6,148,624 | A * | 11/2000 | Bishop et al. | 62/137 |
| 6,425,259 | B2 * | 7/2002 | Nelson et al. | 62/344 |
| 6,442,954 | B1 * | 9/2002 | Shapiro et al. | 62/137 |
| 7,040,111 | B2 * | 5/2006 | Lee et al. | 62/344 |
| 2005/0217307 | A1 * | 10/2005 | Kim et al. | 62/408 |
| 2005/0241329 | A1 * | 11/2005 | Castrellon et al. | 62/340 |
| 2007/0113578 | A1 * | 5/2007 | Wu et al. | 62/344 |

FOREIGN PATENT DOCUMENTS

| | | | |
|---|---|---|---|
| KR | 10-0195449 | | 2/1999 |
| KR | 2004067646 | A * | 7/2004 |
| KR | 10-2005-0034422 | | 4/2005 |
| KR | 10-2005-0100126 | | 10/2005 |
| KR | 10-2005-0119434 | | 12/2005 |

* cited by examiner

*Primary Examiner* — Cheryl J Tyler
*Assistant Examiner* — David Teitelbaum
(74) *Attorney, Agent, or Firm* — Staas & Halsey LLP

(57) ABSTRACT

Disclosed is a refrigerator, in which the structure of an ice supply device is improved. The refrigerator includes a main body, in which at least one storage chamber is formed; a door opening and closing the at least one storage chamber; an ice making unit provided on a rear surface of the door to make ice; an ice storage container provided under the ice making unit to store the ice made by the ice making unit; and at least one receiving rack provided on at least one side of right and left sides of the ice making unit or the ice storage container.

19 Claims, 12 Drawing Sheets

REFRIGERATOR WITH ICE SUPPLY DEVICE

CROSS-REFERENCE TO RELATED APPLICATIONS

This application claims the benefit of Korean Patent Application No. 2008-0118904, filed on Nov. 27, 2008, in the Korean Intellectual Property Office, the disclosure of which is incorporated herein by reference.

BACKGROUND

1. Field

Embodiments of the present invention relate to a refrigerator, in which the structure of an ice supply device is improved.

2. Description of the Related Art

In general, a refrigerator is an apparatus to store foods at a low temperature, and includes a freezing chamber, in which foods are stored at a comparatively low temperature, and a refrigerating chamber, in which foods are stored at a comparatively high temperature, compared with the freezing chamber.

Refrigerators having various supplementary functions according to customer's requirements have been developed and manufactured recently. As a leading one of the refrigerators having supplementary functions, there is a refrigerator having an ice supply device, which manufactures ice by collecting water supplied from the outside, and stores and supplies the ice.

The ice supply device generally includes an ice making unit to manufacture ice, an ice storage container to store the ice manufactured by the ice making unit, and an ice receiving unit formed at the front surface of the refrigerator such that a user receives the ice stored in the ice storage container.

SUMMARY

Therefore, one aspect of the embodiments is to provide a refrigerator, in which the structure of an ice supply device is improved.

Additional aspects and/or advantages will be set forth in part in the description which follows and, in part, will be apparent from the description, or may be learned by practice of the invention.

The foregoing and/or other aspects are achieved by providing a refrigerator including a main body to store foodstuff to be cooled, in which at least one storage chamber is formed, a door to open and close the at least one storage chamber, an ice making unit provided on a rear surface of the door to make ice, an ice storage container provided under the ice making unit to store the ice made by the ice making unit, and at least one receiving rack provided on at least one side of right and left sides of the ice making unit or the ice storage container.

The ice storage container may be rotatably connected to the door, and be rotated between a mounted state and a separated state.

The refrigerator may further include rotation protrusions provided on upper and lower portions of one side of one of the ice storage container and the door, and rotation grooves, into which the rotation protrusions are inserted, provided on the other one of the ice storage container and the door.

The refrigerator may further include a hand grip rotatably connected to the ice storage container and provided with a first locking part at one end of the hand grip, and a second locking part provided on the door such that the second locking part is capable of being locked with the first locking part.

The refrigerator may further include an ice transfer unit to transfer the ice stored in the ice storage container to an ice outlet formed through the ice storage container, the ice transfer unit may include an ice transfer member rotatably provided in the ice storage container, and a driving motor provided on the rear surface of the door to generate driving force transferred to the ice transfer member, and a rotary shaft of the ice transfer member and an output shaft of the driving motor may be selectively connected and disconnected according to the rotation of the ice storage container.

The output shaft of the ice transfer member may be parallel with the rear surface of the door in the mounted state of the ice storage container.

The refrigerator may further include an opening and closing member provided on the ice storage container to open and close an ice outlet formed at one side of the ice storage container, and the opening and closing member may selectively open and close the ice outlet by interlocking with the rotating motion of the ice storage container.

The refrigerator may further include an elastic member to elastically bias the opening and closing member in a direction of closing the ice outlet, and a guide part provided on the door to apply opening force to the opening and closing member in a direction of opening the ice outlet according to the rotation of the ice storage container from the separated state to the mounted state.

The opening and closing member may be rotatably provided on the ice storage container.

The opening and closing member may be slidably provided on the ice storage container.

The ice making unit may include a pair of ice trays configured to receive water to be frozen into ice, driven gears respectively provided at one side of each of the ice trays, and a driving gear engaged with the driven gears to be rotatable in order to separate the ice from the ice trays upon rotation.

The foregoing and/or other aspects are achieved by providing a refrigerator including a main body, in which a freezing chamber and a refrigerating chamber are formed, a freezing chamber door and a refrigerating chamber door to respectively open and close the freezing chamber and the refrigerating chamber, a diaphragm to divide a rear surface of the freezing chamber door into right and left sides, an ice making unit provided at one side of the right and left sides of the diaphragm to make ice, an ice storage container provided under the ice making unit at the one side of the diaphragm to store the ice made by the ice making unit, and at least one receiving rack provided at the other side of the right and left sides of the diaphragm.

One side of the ice storage container may be rotatably connected to frames installed on the freezing chamber door.

The refrigerator may further include a first locking part provided on one of a free terminal side of the ice storage container and the freezing chamber door, and a second locking part provided on the other one of the free terminal side of the ice storage container and the freezing chamber door.

The refrigerator may further include an ice transfer unit to transfer the ice stored in the ice storage container to an ice outlet formed through the ice storage container, the ice transfer unit may include an ice transfer member rotatably provided in the ice storage container, and a driving motor provided on the rear surface of the freezing chamber door to generate driving force transferred to the ice transfer member, and a rotary shaft of the ice transfer member and an output shaft of the driving motor may be selectively connected and disconnected according to the rotation of the ice storage container.

The refrigerator may further include an opening and closing member to open and close an ice outlet formed through the ice storage container, and the opening and closing member may selectively open and close the ice outlet according to the rotating state of the ice storage container.

The foregoing and/or other aspects are achieved by providing a refrigerator including a main body configured to store foodstuff to be cooled, in which a storage chamber is formed, a door to open and close the storage chamber, a diaphragm to divide the rear surface of the door into right and left sides, an ice making unit provided at one side of the right and left sides of the diaphragm to make ice, an ice storage container provided under the ice making unit at the one side of the diaphragm to store the ice made by the ice making unit, and including an ice outlet being provided at one side of the ice storage container, a discharge chute formed through the door to connect the ice outlet and an ice receiving part formed on the front surface of the door, an ice transfer unit to transfer the ice stored in the ice storage container to the ice outlet, and at least one receiving rack provided at the other side of the right and left sides of the diaphragm.

The ice storage container may be rotatably connected to the door, and be rotated between a mounted state and a separated state.

The ice transfer unit may include an ice transfer member rotatably provided in the ice storage container, and a driving motor provided on the rear surface of the door to generate driving force transferred to the ice transfer member, and a rotary shaft of the ice transfer member and an output shaft of the driving motor may be selectively connected and disconnected according to the rotation of the ice storage container.

The refrigerator may further include an opening and closing member provided on the ice storage container to open and close an ice outlet formed at one side of the ice storage container, and the opening and closing member may selectively open and close the ice outlet by interlocking with the rotating motion of the ice storage container.

The foregoing and/or other aspects are achieved by providing a refrigerator, including: a main body configured to store foodstuff to be cooled, in which at least one storage chamber is formed; a door opening and closing the at least one storage chamber; an ice making unit provided on a rear surface of the door to make ice; and an, ice storage container provided under the ice making unit on the rear surface of the door to store the ice made by the ice making unit and being rotatable between a mounted state with respect to the door and a separated state with respect to the door, the ice storage container including an ice transfer unit having a rotary shaft to transfer the ice stored in the ice storage container, the rotary shaft of the ice transfer unit being parallel with the rear surface of the door in the mounted state.

The refrigerator may further include a driving motor provided on the rear surface of the door and generating a driving force to be transferred to the rotary shaft.

The ice storage container may include an ice outlet defined therethrough to receive ice transferred by the ice transfer unit.

The ice storage container may further include an opening and closing member opening and closing the ice outlet.

The foregoing and/or other aspects are achieved by providing an ice supply device configured to attach to a rear surface of a door of a refrigerator, the ice supply device including: an ice making unit provided on the rear surface of the door to make ice; and an ice storage container provided under the ice making unit on the rear surface of the door to store the ice made by the ice making unit and being rotatable between a mounted state with respect to the door and a separated state with respect to the door, the ice storage container including an ice transfer unit having a rotary shaft to transfer the ice stored in the ice storage container, the rotary shaft of the ice transfer unit being parallel with the rear surface of the door in the mounted state.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION OF EMBODIMENTS

Figure 1:
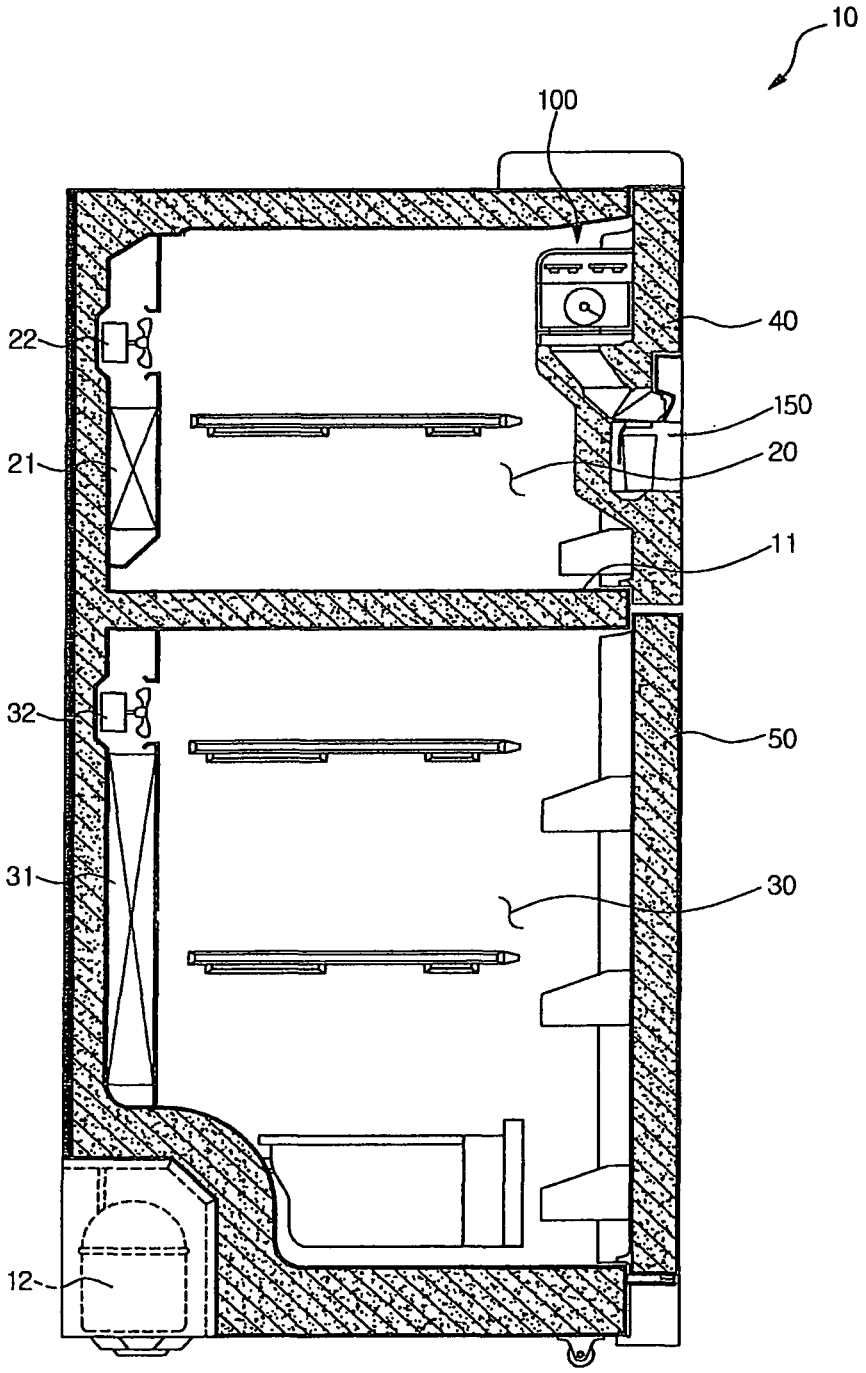
FIG. 1 is a longitudinal sectional view illustrating a refrigerator in accordance with one embodiment.

Reference will now be made in detail to the embodiments, examples of which are illustrated in the accompanying drawings, wherein like reference numerals refer to like elements throughout.

FIG. 1 is a longitudinal sectional view illustrating a refrigerator in accordance with one embodiment.

As shown in FIG. 1, the refrigerator in accordance with the present embodiment includes a main body 10 having a freezing chamber 20 and a refrigerating chamber 30, which are divided from each other by an intermediate diaphragm 11.

The front surfaces of the freezing chamber 20 and the refrigerating chamber 30 are opened, the freezing chamber 20 which may be located at the upper portion of the main body 10, for example, is opened and closed by a freezing chamber door 40, and the refrigerating chamber 30 which may be located at the lower portion of the main body 10, for example, is opened and closed by a refrigerating chamber door 50.

A freezing chamber evaporator 21 to cool the freezing chamber 20 and a freezing chamber circulation fan 22 to circulate cold air of the freezing chamber 20 may be installed at the rear portion of the inside of the freezing chamber 20. Further, a refrigerating chamber evaporator 31 to cool the refrigerating chamber 30 and a refrigerating chamber circulation fan 32 to circulate cold air of the refrigerating chamber 30 may be installed at the rear portion of the inside of the refrigerating chamber 30. The refrigerator includes a compressor 12 to compress a refrigerant supplied to the freezing chamber evaporator 21 and the refrigerating chamber evaporator 31.

The freezing chamber door 40 and the refrigerating chamber door 50 are rotatably connected to the main body 10 such that the freezing chamber door 40 and the refrigerating chamber door 50 are rotated horizontally to open and close the freezing chamber 20 and the refrigerating chamber 30. The disposition and the structure of the doors to open and close respectively storage chambers, i.e., the freezing chamber 20 and the refrigerating chamber 30 in accordance with this embodiment are exemplary, and may be variously modified.

As shown in FIG. 1, an ice supply device 100 is provided on the freezing chamber door 40 of the refrigerator in accordance with this embodiment. Hereinafter, the ice supply device 100 in accordance with this embodiment will be described.

Figure 2:
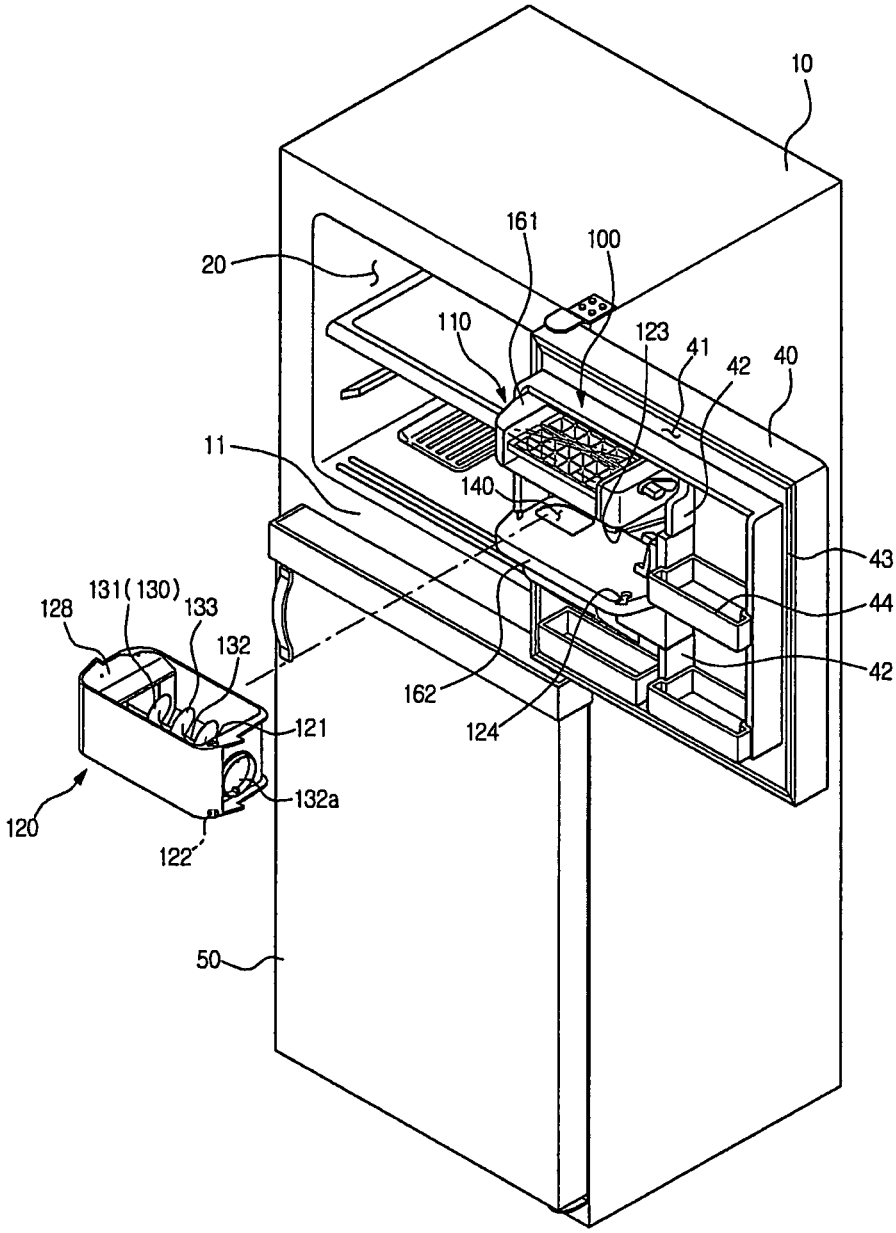
FIG. 2 is a perspective view illustrating an ice supply device of the refrigerator in accordance with the embodiment.
Figure 3:
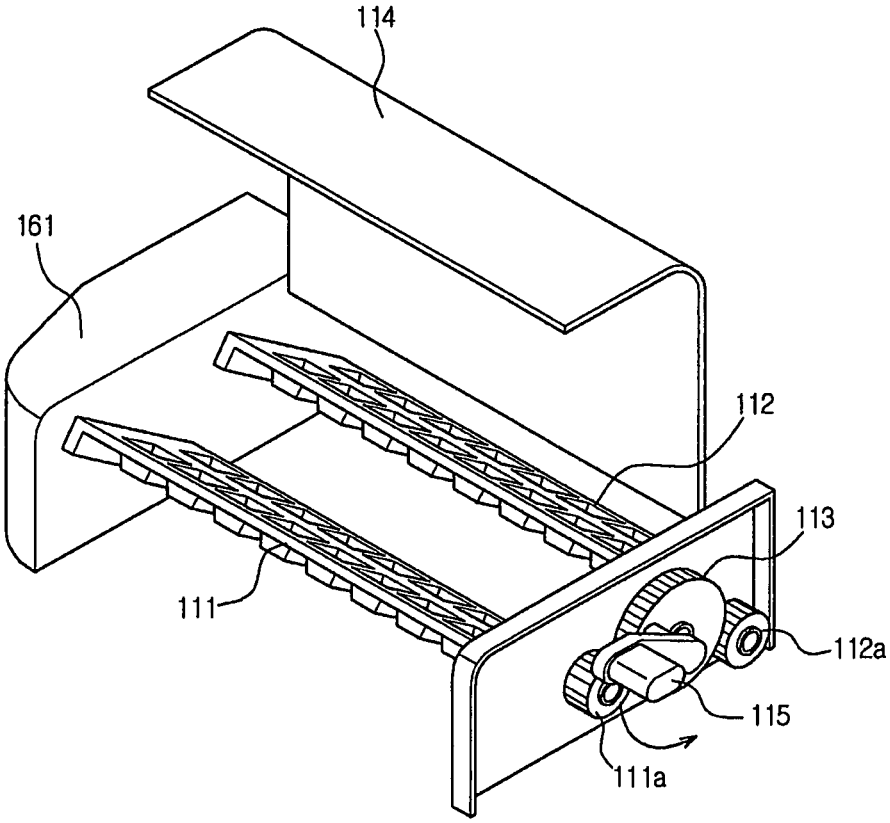
FIG. 3 is a perspective view illustrating an ice making unit in accordance with the embodiment.
Figure 4A:
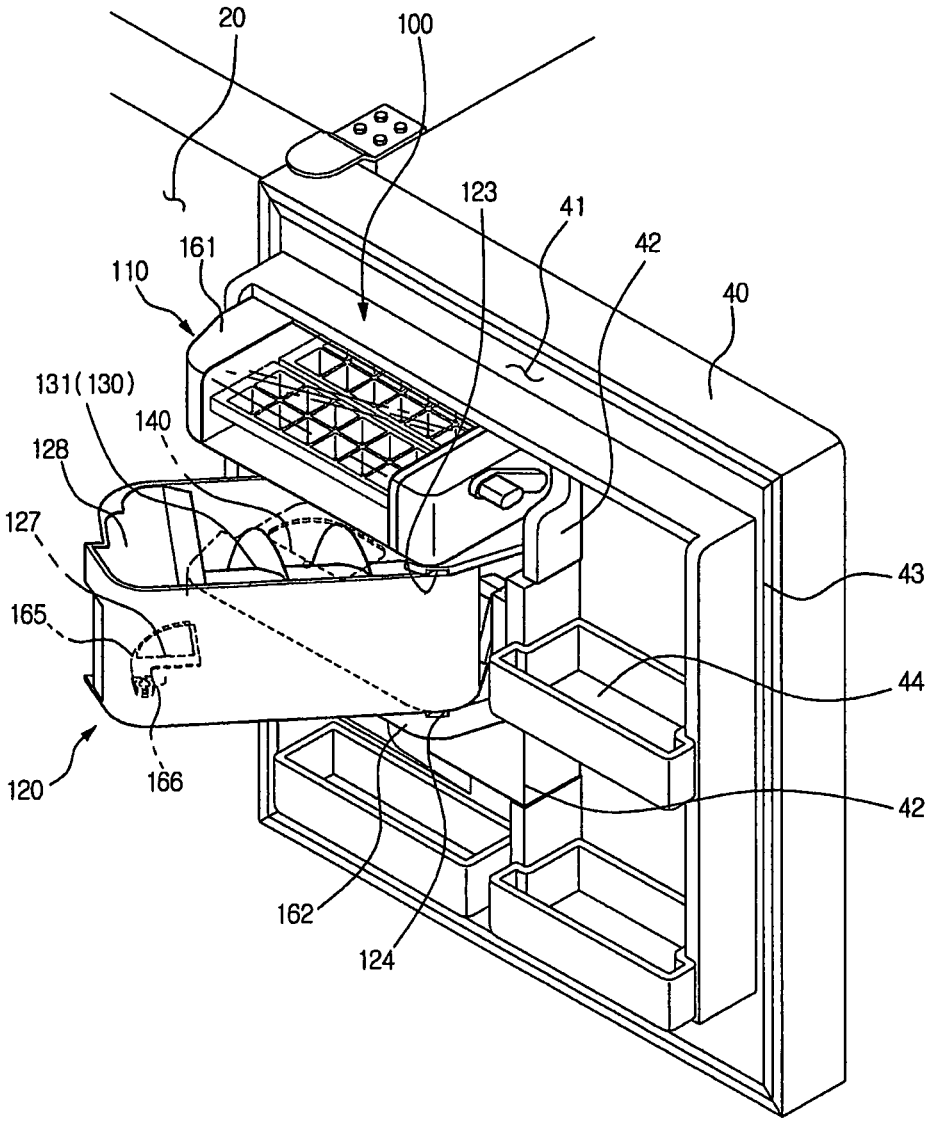
FIGS. 4A and 4C are perspective views and FIGS. 4B and 4D are top views illustrating the rotating motion of an ice storage container in accordance with the embodiment.
Figure 4B:
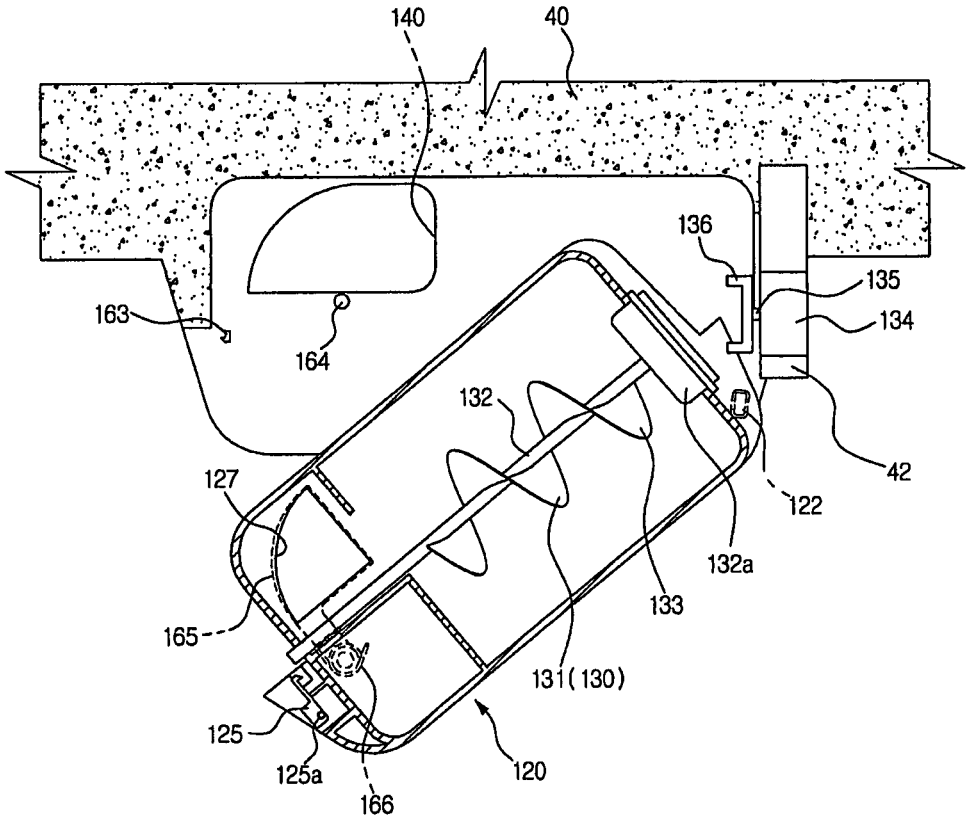
Figure 4C:
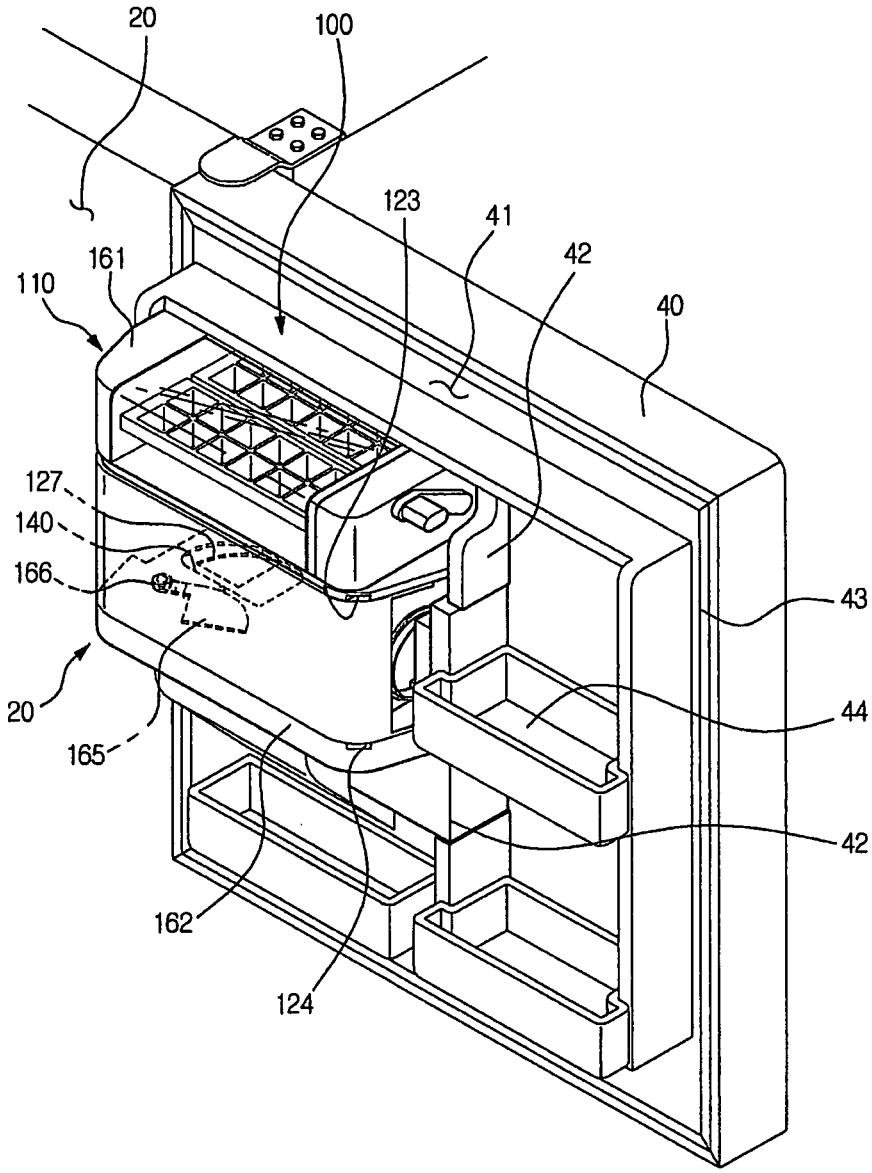
Figure 4D:
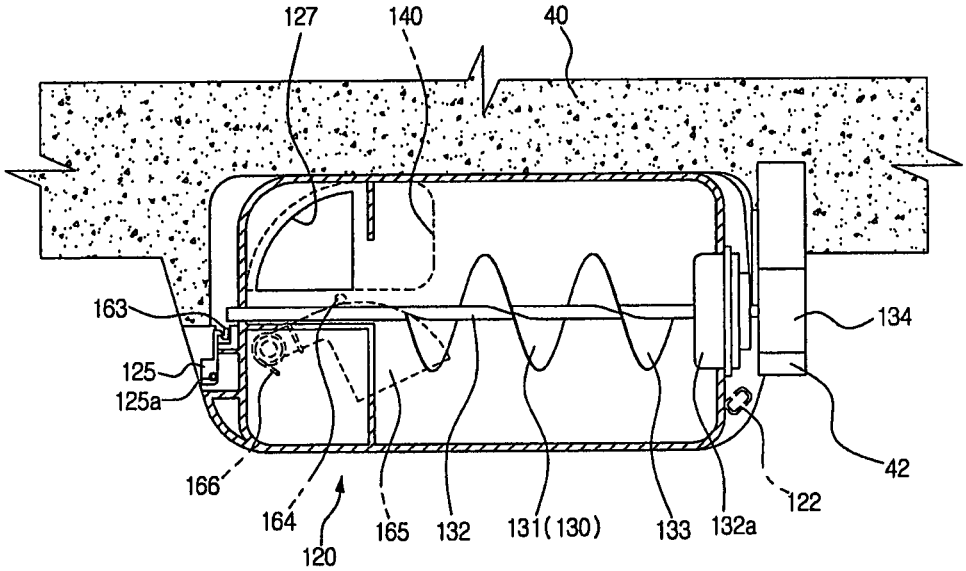
Figure 5:
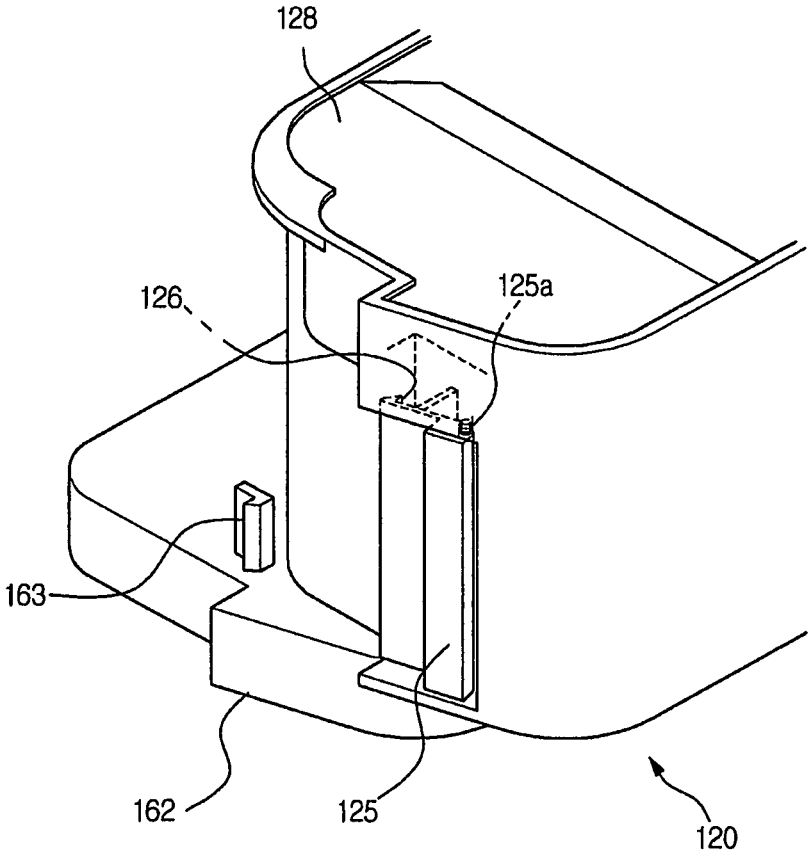
FIG. 5 is a view illustrating a first locking part and a second locking part in accordance with the embodiment.
Figure 6A:
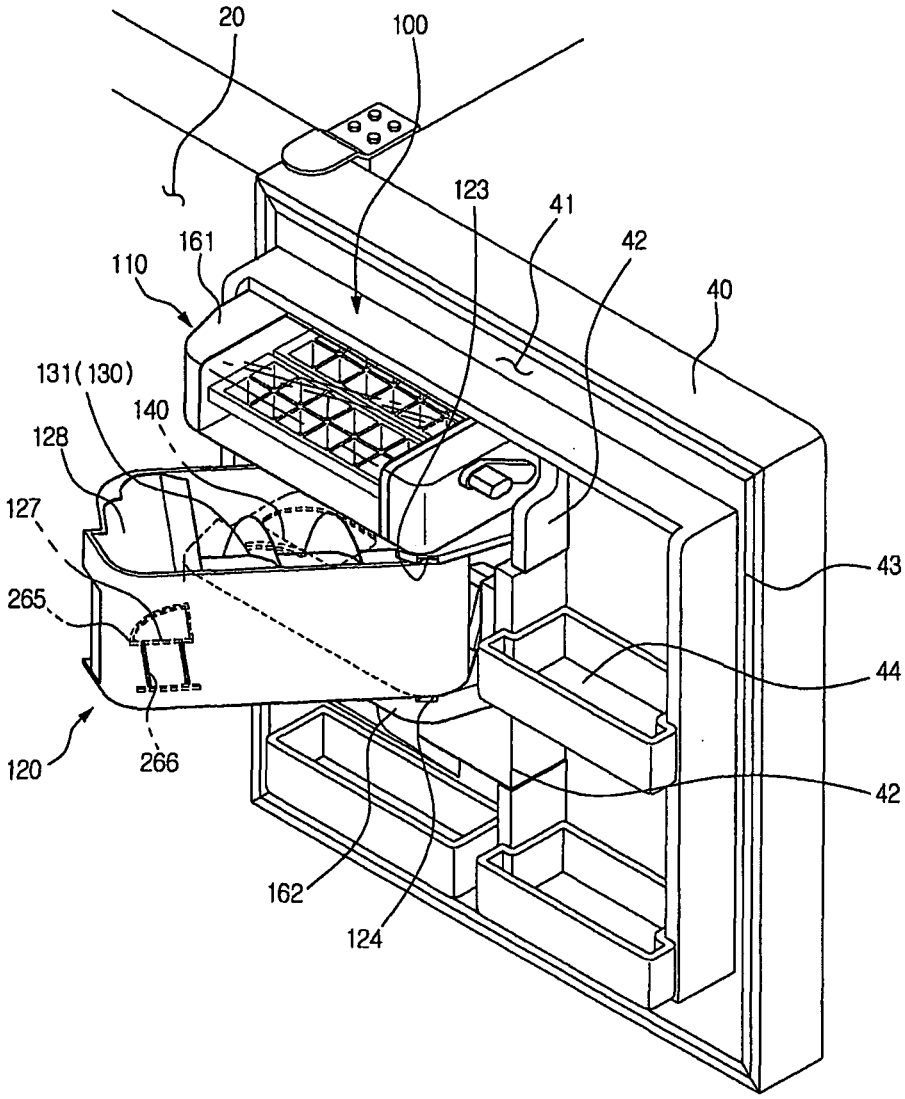
FIGS. 6A and 6C are perspective views and FIGS. 6B and 6D are top views illustrating the rotating motion of an ice storage container in accordance with another embodiment.
Figure 6B:
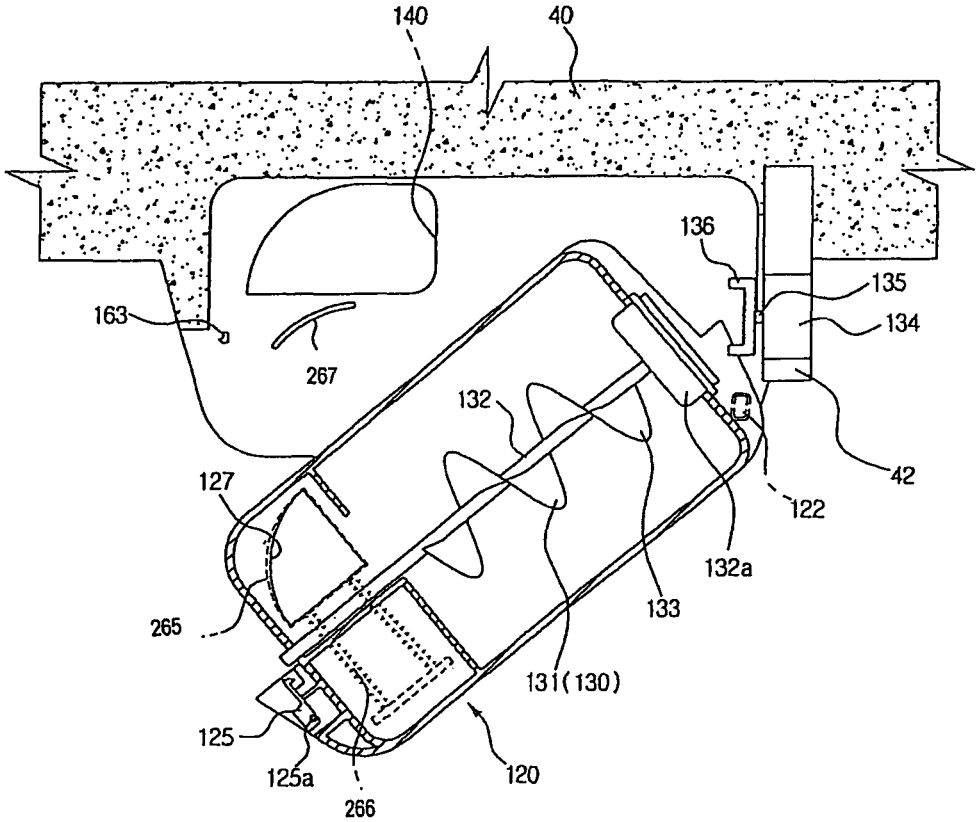
Figure 6C:
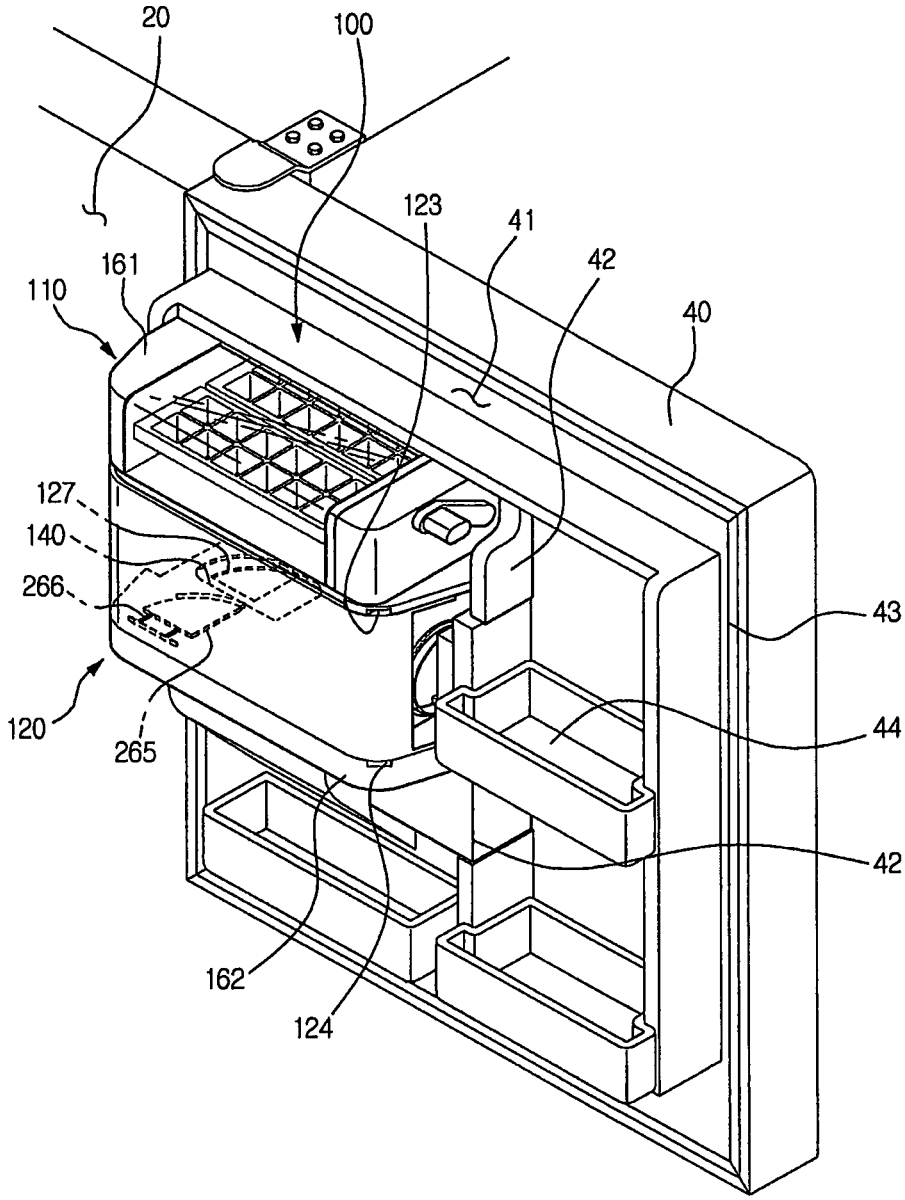
Figure 6D:
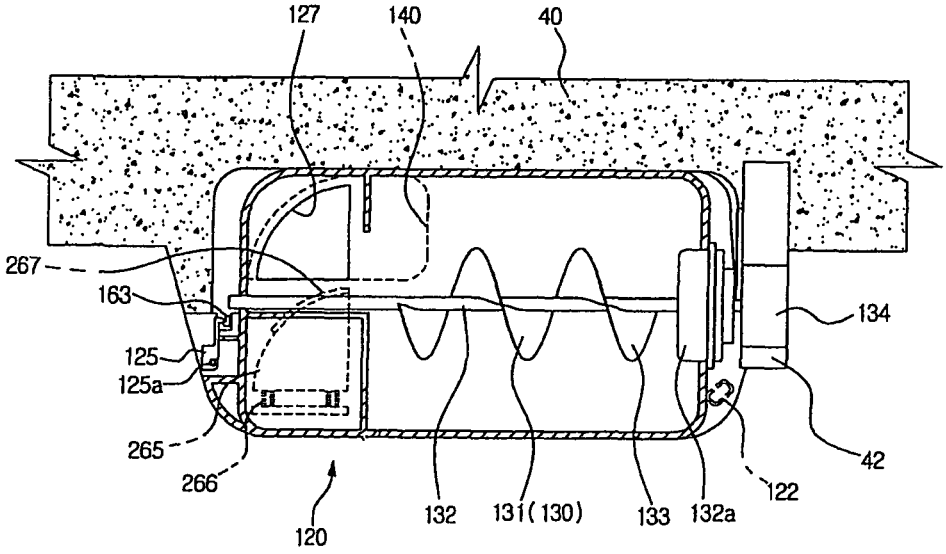

FIG. 2 is a perspective view illustrating the ice supply device of the refrigerator in accordance with the embodiment, and FIG. 3 is a perspective view illustrating an ice making unit in accordance with the embodiment, FIGS. 4A and 4C are perspective views and FIGS. 4B and 4D are top views illustrating the rotating motion of an ice storage container in accordance with the embodiment, and FIG. 5 is a view illustrating a first locking part and a second locking part in accordance with the embodiment of the present invention. Further, FIGS. 6A and 6C are perspective views and FIGS. 6B and 6D are top views illustrating the rotating motion of an ice storage container in accordance with another embodiment.

As shown in FIG. 2, the ice supply device 100 in accordance with this embodiment includes an ice making unit 110, an ice storage container 120, an ice transfer unit 130, a discharge chute 140, and an ice receiving part 150 (shown in FIG. 1). The ice supply device 100 is provided on a rear surface 41 of the freezing chamber door 40, and is located at the left side of a diaphragm 42, which divides the freezing chamber door 40 into right and left portions, for example, although the position of the ice supply device 100 is not limited thereto. The ice supply device 100 includes an upper frame 161 and a lower frame 162, and the upper frame 161 and the lower frame 162 of this embodiment respectively form external appearances of upper and lower portions of the ice transfer unit 130 and simultaneously support the ice making unit 110 and the ice storage container 120. Although the upper frame 161 and the lower frame 162 of this embodiment are separately manufactured and connected to the rear surface 41 of the freezing chamber door 40, the upper frame 161 and the lower frame 162 may be manufactured integrally with the rear surface 41 of the freezing chamber door 40 and thus form a portion of the freezing chamber door 40.

As shown in FIGS. 2 and 3, the ice making unit 110 may include a pair of ice trays 111 and 112, which contain water to be frozen into ice, driven gears 111*a* and 112*a* respectively provided at one side of each of the ice trays 111 and 112, and a driving gear 113 engaged with the driven gears 111*a* and 112*a*.

A user opens a cover 114, which may be transparent, which is rotatably installed at the upper frame 161, and then supplies water to be frozen into the ice trays 111 and 112. After ice making has been completed, the user rotates a lever 115 connected to the driving gear 113, and thus separates ice from the ice trays 111 and 112. The separated ice is dropped down to the ice storage container 120 provided under the ice making unit 110 by its own weight.

Of course, a separate driving motor may be connected to the driving gear 113 to automatically control the separation of the ice from the ice trays 111 and 112, or a heat wire to facilitate the separation of the ice may be added to the ice trays 111 and 112.

The ice storage container 120 is rotatably connected to the freezing chamber door 40, and is rotated between a separated state (with reference to FIGS. 4A and 4B) and a mounted state (with reference to FIGS. 4C and 4D). On this account, the ice supply device 100 of this embodiment includes rotation protrusions 121 and 122 provided on upper and lower portions of one side of the ice storage container 120, and rotation grooves 123 and 124, into which the rotation protrusions 121 and 122 are inserted, provided on the upper frame 161 and the lower frame 162 installed on the freezing chamber door 40. Hereinafter, the mounted state refers to a state in which the ice supply device 100 is operable, and the separated state refers to a state in which the ice storage container 120 is rotated from the mounted state. Further, a completely separated state, which will be described later, refers to a state in which the ice storage container 120 is completely seceded from the freezing chamber door 40.

Although the ice storage container 120 of this embodiment is rotatably connected to the freezing chamber door 40 through the upper frame 161 and the lower frame 162, the ice storage container 120 may be connected directly to the freezing chamber door 40. Of course, as described above, the upper frame 161 and the lower frame 162 may be formed integrally with the freezing chamber door 40 and thus form a portion of the freezing chamber door 40. Further, rotation grooves may be provided on upper and lower portions of one side of the ice storage container 120, and rotation protrusions, which are inserted into the rotation grooves, may be provided on the upper frame 161 and the lower frame 162. Additionally, the ice storage container 120 may be rotatably mounted to either or both of the frames 161, 162 by any rotatably connecting device.

The ice supply device 100 of this embodiment further includes a first locking part 126 (shown in FIG. 5) provided on a hand grip 125 of the ice storage container 120 to stably mount the ice storage container 120 on the freezing chamber door 40, and a second locking part 163 provided on the freezing chamber door 40, more particularly on the lower frame 162 (Shown in FIG. 5) installed on the freezing chamber door 40, to be locked with the first locking part 126. As shown in the drawings, the hand grip 125 is rotatably connected to the ice storage container 120, and is elastically biased by a coil spring 125a. Thereby, when the user rotates the ice ice storage container 120 to the freezing chamber door 40, the first locking part 126 is locked with the second locking part 163, and when the user grasps the hand grip 125, the locking between the first locking part 126 and the second locking part 163 is released by the grasping force. The shapes of the first locking part 126 and the second locking part 163 are not limited to that shown in the Figures, but may be any type of lock-type combination releasably uniting one part on the ice storage container 120 with another part on the door 40.

The ice transfer unit 130 transfers the ice stored in the ice storage container 120 to an ice outlet 127 formed through the ice storage container 120. The ice transfer unit 130 of this embodiment includes an ice transfer member 131 rotatably provided in the ice storage container 120, and a driving motor 134 provided on the rear surface 41 of the freezing chamber door 40 to generate a driving force transferred to the ice transfer member 131.

The ice transfer member 131 is formed as an auger type, and includes a rotary shaft 132 and a blade 133. The ice in the ice storage container 120 is transferred to the ice outlet 127 formed through the ice storage container 120 by the rotation of the rotary shaft 132. Here, under the condition that the ice storage container 120 is mounted on the freezing chamber door 40, the rotary shaft 132 of this embodiment is disposed parallel with the rear surface 41 of the freezing chamber door 40.

The ice storage container 120 is rotated, and thus is attached to and detached from the freezing chamber door 40. Therefore, the rotary shaft 132 of the ice transfer member 131 and an output shaft 135 of the driving motor 134 are selectively connected and disconnected by the rotation of the ice storage container 120. The ice storage container 120 also includes a first connection part 132*a* provided on the rotary shaft 132 of the ice transfer member 131 and a second connection part 136 provided on the output shaft 135 of the driving motor 134.

Further, the ice outlet 127 of the ice storage container 120 of this embodiment is selectively opened and closed by interlocking with the rotation of the ice storage container 120. On this account, the refrigerator in accordance with this embodiment further includes an opening and closing member 165 rotatably provided on the ice storage container 120, an elastic member 166 to elastically bias the opening and closing member 165 in a direction of closing the ice outlet 127, and a guide part 164 provided on the lower frame 162 on the freezing chamber door 40 to apply opening force to the opening and closing member 165 in a direction of opening the ice outlet 127 according to the rotation of the ice storage container 120 from the separated state to the mounted state. Thereby, when the ice storage container 120 is separated from the freezing chamber door 40 to check an ice storage amount and clean the storage container 120, i.e., in the case of the separated state or the completely separated state of the ice storage container 120, the ice outlet 127 of the ice storage container 120 is automatically closed by the opening and closing member 165. Accordingly, it may be possible to prevent the ice from being lost through the ice outlet 127 during a process of separating the ice storage container 120 from the freezing chamber door 40. Further, the user separates the ice storage container 120 from the freezing chamber door 40 without separate carefulness, and thus convenience in use is improved.

The opening and closing member 165 is not limited to the structure, which is described in this embodiment. That is, as shown in FIGS. 6A to 6D, the opening and closing member 265 is slidably provided on the ice storage container 120 and is elastically biased in a direction of opening and closing the ice outlet 127 of the ice storage container 120 by an elastic member 266. a guide 267 is provided on the lower frame 162 to apply pressure to the opening and closing member 165 in the direction of opening the ice outlet 127 when the ice storage container 120 is mounted on the freezing chamber door 40.

The ice storage container may include a plate 128, which prevents the ice separated from the ice trays 111 and 112 from being put directly into the discharge chute 140.

The discharge chute 140 is formed through the freezing chamber door 40 to connect the ice outlet 127 and the ice receiving unit 150 formed on the front surface of the freezing chamber door 40.

As described above, in the refrigerator in accordance with this embodiment, the ice supply device 100 including the ice making unit 110 and ice storage container 120 is compactly installed at one side of the diaphragm 42 of the freezing chamber door 40, and thus at least one receiving rack 44 is able to be installed at the other side of the diaphragm 42 of the freezing chamber door 40. Thereby, the space utility of the freezing chamber door 40 is improved. Particularly, the rotary shaft 132 of the ice transfer member 131 of this embodiment is parallel with the rear surface 41 of the freezing chamber door 40, the height of a structure protruded from the rear surface 41 of the freezing chamber door 40 in the perpendicular direction is relatively low, and thus the space utility of the freezing chamber door 40 is more improved.

In the ice supply device 100 of this embodiment, since the ice storage container 120 is connected to the freezing chamber door 40 in the rotating method, it is easier to dispose the ice transfer member 131 provided in the ice storage container 120 in parallel with the rear surface 41 of the freezing chamber door 40. Concretely, in the refrigerator of this embodiment, it may be possible to prevent the interference between a member, such as a gasket 43 provided at an edge of the freezing chamber door 40, and the ice storage container 120, while connecting the rotary shaft 132 of the ice transfer member 131 and the output shaft 135 of the driving motor 134. Further, as shown in FIG. 2, it may be possible to insert the ice storage container 120 into the rear surface of the freezing chamber door 40 to a designated depth.

Although exemplary embodiments are exemplarily described above, the present invention may be variously modified.

Although these embodiments describe the ice supply device provided on the rear surface of the freezing chamber door at the left portion of the diaphragm dividing the freezing chamber door into the right and left portions, the ice supply device may be provided at the right portion of the diaphragm. Of course, although these embodiments describe the diaphragm, which is partially cut or formed in a stepwise shape, the diaphragm dividing the freezing chamber door into the right and left portions may be continuously formed. Further, although these embodiments divide a space, in which the ice supply device is installed, and a space, in which the receiving racks are installed, from each other by the diaphragm, the ice supply device may be provided in one portion of the right and left portions of the door without the diaphragm and the receiving racks may be provided in the other portion of the right and left portions of the door.

Further, although the ice making unit is provided on the rear surface of the freezing chamber door and ice is made by cold air in the freezing chamber in the refrigerator in accordance with these embodiments, a separate cold air supply unit may be provided. Of course, the ice supply device of the present embodiments may be provided on the rear surface of the refrigerating chamber door other than the freezing chamber door, and in this case, it is preferable that a cold air supply unit to make ice is separately provided in the refrigerator.

The refrigerator in accordance with the embodiments has an improved structure of the ice supply device, thus improving the space utility of a storage chamber and the convenience of users.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a main body configured to store foodstuff to be cooled, in which at least one storage chamber is formed;

a door to open and close the at least one storage chamber;

an ice making unit provided on a rear surface of the door to make ice;

an ice storage container provided under the ice making unit to store the ice made by the ice making unit, the ice storage container being rotatably connected to the door and rotated between a mounted state and a separated state;

an opening and closing member provided on the ice storage container to open and close an ice outlet formed at one side of the ice storage container, the opening and closing member to selectively open and close the ice outlet by interlocking with a rotating motion of the ice storage container; and at least one receiving rack provided on at least one side of right and left sides of the ice making unit or the ice storage container.

2. The refrigerator according to claim 1, further comprising:

rotation protrusions provided on upper and lower portions of one side of one of the ice storage container and the door; and rotation grooves, into which the rotation protrusions are inserted, provided on the other one of the ice storage container and the door.

3. The refrigerator according to claim 1, further comprising:

a hand grip rotatably connected to the ice storage container and provided with a first locking part at one end of the hand grip; and a second locking part provided on the door such that the second locking part is capable of locking with the first locking part.

4. The refrigerator according to claim 1, further comprising an ice transfer unit to transfer the ice stored in the ice storage container to an ice outlet formed through the ice storage container, the ice transfer unit including an ice transfer member rotatably provided in the ice storage container and including a rotor shaft, and a driving motor provided on the rear surface of the door to generate driving force to be transferred to the ice transfer member and including an output shaft, the rotary shaft and the output shaft being selectively connected and disconnected to each other according to the rotation of the ice storage container.

5. The refrigerator according to claim 4, wherein the rotary shaft of the ice transfer member is parallel with the rear surface of the door in the mounted state of the ice storage container.

6. The refrigerator according to claim 1, further comprising:

an elastic member to be elastically biased the opening and closing member in a direction of closing the ice outlet; and a guide part provided on the door to apply opening force to the opening and closing member in a direction of opening the ice outlet according to the rotation of the ice storage container from the separated state to the mounted state.

7. The refrigerator according to claim 6, wherein the opening and closing member is rotatably provided on the ice storage container.

8. The refrigerator according to claim 6, wherein the opening and closing member is slidably provided on the ice storage container.

9. The refrigerator according to claim 1, wherein the ice making unit includes:

a pair of ice trays configured to receive water to be frozen into ice;

driven gears respectively provided at one side of each of the ice trays; and a driving gear engaged with the driven gears to be rotatable in order to separate the ice from the ice trays upon rotation.

10. A refrigerator, comprising:

a main body configured to store foodstuff to be cooled, in which a freezing chamber and a refrigerating chamber are formed;

a freezing chamber door and a refrigerating chamber door to respectively open and close the freezing chamber and the refrigerating chamber;

a diaphragm to divide a rear surface of the freezing chamber door into right and left sides;

an ice making unit provided at one side of the right and left sides of the diaphragm to make ice;

an ice storage container provided under the ice making unit at the one side of the diaphragm to store the ice made by the ice making unit, the ice storage container being rotatably connected to the freezing chamber door and rotated between a mounted state and a separated state;

an opening and closing member provided on the ice storage container to open and close an ice outlet formed at one side of the ice storage container, the opening and closing member to selectively open and close the ice outlet by interlocking with a rotating motion of the ice storage container; and at least one receiving rack provided at the other side of the right and left sides of the diaphragm.

11. The refrigerator according to claim 10, wherein one side of the ice storage container is rotatably connected to frames installed on the freezing chamber door.

12. The refrigerator according to claim 11, further comprising:

a first locking part provided on one of a free terminal side of the ice storage container and the freezing chamber door; and a second locking part provided on the other one of the free terminal side of the ice storage container and the freezing chamber door to releasably engage with the first locking part.

13. The refrigerator according to claim 11, further comprising an ice transfer unit to transfer the ice stored in the ice storage container to an ice outlet formed through the ice storage container, the ice transfer unit including an ice transfer member rotatably provided in the ice storage container and including a rotary shaft, and a driving motor provided on a rear surface of the freezing chamber door to generate driving force to be transferred to the ice transfer member and including an output shaft, the rotary shaft and the output shaft being selectively connected and disconnected according to the rotation of the ice storage container.

14. A refrigerator, comprising:

a main body configured to store foodstuff to be cooled, in which a storage chamber is formed;

a door to open and close the storage chamber;

a diaphragm to divide a rear surface of the door into right and left sides;

an ice making unit provided at one side of the right and left sides of the diaphragm to make ice;

an ice storage container provided under the ice making unit at the one side of the diaphragm to store the ice made by the ice making unit, and including an ice outlet provided at one side of the ice storage container, the ice storage container being rotatably connected to the door and rotated between a mounted state and a separated state;

a discharge chute formed through the door to connect the ice outlet and an ice receiving part formed on a front surface of the door;

an ice transfer unit to transfer the ice stored in the ice storage container to the ice outlet;

an opening and closing member provided on the ice storage container to open and close an ice outlet formed at one side of the ice storage container, the opening and closing member to selectively open and close the ice outlet by interlocking with a rotating motion of the ice storage container; and at least one receiving rack provided at the other side of the right and left sides of the diaphragm.

15. The refrigerator according to claim 14, wherein:

the ice transfer unit includes an ice transfer member rotatably provided in the ice storage container and including a rotary shaft, and a driving motor provided on the rear surface of the door to generate driving force to be transferred to the ice transfer member and including an output shaft the rotary shaft and the output shaft being selectively connected and disconnected according to the rotation of the ice storage container.

16. A refrigerator, comprising:

a main body configured to store foodstuff to be cooled, in which at least one storage chamber is formed;

a door to open and close the at least one storage chamber;

an ice making unit provided on a rear surface of the door to make ice;

an ice storage container provided under the ice making unit on the rear surface of the door to store the ice made by the ice making unit and being rotatable between a mounted state with respect to the door and a separated state with respect to the door, the ice storage container including an ice transfer unit having a rotary shaft to transfer the ice stored in the ice storage container, the rotary shaft of the ice transfer unit being parallel with the rear surface of the door in the mounted state; and an opening and closing member provided on the ice storage container to open and close an ice outlet formed at one side of the ice storage container, the opening and closing member to selectively open and close the ice outlet by interlocking with a rotating motion of the ice storage container.

17. The refrigerator according to claim 1, further comprising a driving motor provided on the rear surface of the door and to generate a driving force to be transferred to the rotary shaft.

18. The refrigerator according to claim 16, wherein the ice storage container includes an ice outlet defined therethrough to receive ice transferred by the ice transfer unit.

19. An ice supply device configured to attach to a rear surface of a door of a refrigerator, the ice supply device comprising:

an ice making unit provided on the rear surface of the door to make ice;

an ice storage container provided under the ice making unit on the rear surface of the door to store the ice made by the ice making unit and being rotatable between a mounted state with respect to the door and a separated state with respect to the door, the ice storage container including an ice transfer unit having a rotary shaft to transfer the ice stored in the ice storage container, the rotary shaft of the ice transfer unit being parallel with the rear surface of the door in the mounted state; and an opening and closing member provided on the ice storage container to open and close an ice outlet formed at one side of the ice storage container, the opening and closing member to selectively open and close the ice outlet by interlocking with a rotating motion of the ice storage container.

* * * * *

UNITED STATES PATENT AND TRADEMARK OFFICE

CERTIFICATE OF CORRECTION

PATENT NO. : 8,459,057 B2
APPLICATION NO. : 12/588260
DATED : June 11, 2013
INVENTOR(S) : Ji Hoon Kim et al.

It is certified that error appears in the above-identified patent and that said Letters Patent is hereby corrected as shown below:

Title Page: Item 75

Line 1 (1st Inventor's name), Column 1, Delete "Gwangji (KR);" and insert -- Gwangju (KR); --, therefor.

Line 1 (2nd Inventor's name), Column 1, Delete "Gwangji (KR)" and insert -- Gwangju (KR) --, therefor.

Signed and Sealed this
Eighth Day of October, 2013

Teresa Stanek Rea

Teresa Stanek Rea
*Deputy Director of the United States Patent and Trademark Office*